United States Patent [19]

Kawawa et al.

[11] 4,018,075

[45] Apr. 19, 1977

[54] PLASTIC WORKING DIES FOR CYLINDRICAL PARTS

[75] Inventors: Hiroyuki Kawawa; Yasushi Ohuchi; Hisanobu Kanamaru, all of Katsuta, Japan

[73] Assignee: Hitachi, Ltd., Japan

[22] Filed: Apr. 30, 1976

[21] Appl. No.: 682,044

[30] Foreign Application Priority Data

May 12, 1975 Japan ..... 50-54550

[52] U.S. Cl. ..... 72/467

[51] Int. Cl.[2] ..... B21C 3/00

[58] Field of Search ..... 72/467, 264, 266, 359, 72/377, 370, 362

[56] References Cited

UNITED STATES PATENTS 2,768,742 10/1956 Lumley ..... 72/467

3,605,476 9/1971 Hinshaw ..... 72/467

*Primary Examiner*—Milton S. Mehr

*Attorney, Agent, or Firm*—Craig & Antonelli

[57] ABSTRACT

When cylindrical parts are produced by extrusion from a metallic material having high mechanical strength, the dies tend to be easily broken and worn, and it is difficult to secure accuracy of finishing of the product.

According to the present invention, with regard to the form of a die, the ironing portion is reduced in contact area thereof, is formed into such a configuration that the contact area thereof does not increase even if the dies are worn to some extent, and a die angle and configurations of an ironing portion and a relief portion are selected properly, thus preventing the dies from being easily broken or worn.

1 Claim, 6 Drawing Figures

PLASTIC WORKING DIES FOR CYLINDRICAL PARTS

BACKGROUND OF THE INVENTION

This invention relates to dies suitable for the plastic working for cylindrical parts including metallic tubes and the like.

As an extrusion method for metallic tubes, there has been known such a method that a billet is inserted into a container installed with dies, a small diametral portion (a mandrel) of a punch solidly secured to a press slide is inserted from one side of the billet, thereafter the slide is lowered, the billet is pressed into the dies by use of the large diametral portion of the punch, the billet is subjected to ironing along the outer diameter thereof to be formed into a tubular product, and the product is removed as the slide is elevated.

Heretofore, dies which have been adopted in this field of work include a curved surface die having a curved surface of a relatively large curvature in longitudinal cross-section and a conical shape die having a cross-section of a combination of substantially straight lines from the shoulder portion to the relief portion of the die with the vertex of said each line being at the ironing portion.

The former tends to cause seizing because of increased extrusion pressure due to a large contact area between the billet and the dies at the ironing portion. Consequently, the extrusion of a material having high strength may result in breakage and wear of the dies and is impracticable.

Additionally, with the conical shape dies, a high extrusion pressure is required for a material of high strength, which may result in breakage and wear of the dies. These shortcomings can be obviated by making the relief portion small. However, as the contact area is increased due to the wear of the ironing portion, increased extrusion pressure comes to be required, thus resulting in seizing and breakage of the dies. Further, a large lateral pressure acts on the dies, thus resulting in decreased finishing accuracy of the product.

SUMMARY OF THE INVENTION

The object of the present invention is to provide dies suitable for the extrusion of a metallic tube of high accuracy, made of a material having high mechanical strength.

The feature of the present invention resides in that the contact area between the ironing portion of the dies and the blank is made small, not increased even if the dies are worn, and a die angle and the configurations of an ironing portion and a relief portion are determined based on the ground of theory so that satisfactory mechanical strength can be maintained.

DESCRIPTION OF THE PREFERRED EMBODIMENT

Description will hereunder be given of a preferred embodiment of the present invention with reference to the drawings.

Figure 1:
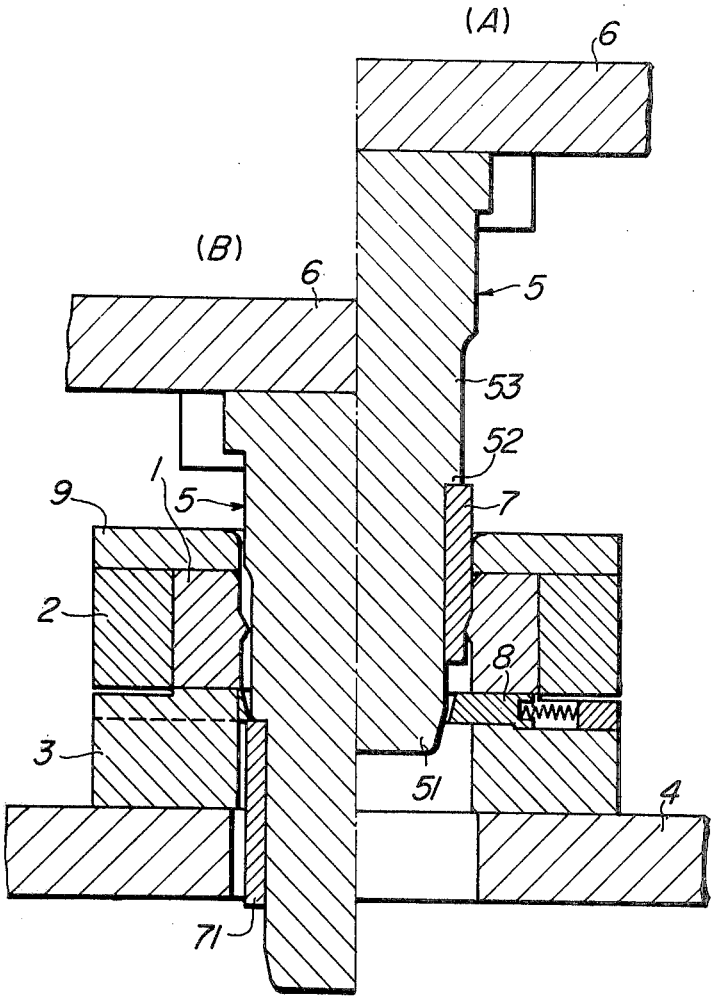
FIG. 1 is a view showing the conditions of the extrusion of a metallic tube.

Firstly, FIG. 1 shows the working conditions of a metallic tube, in which designated at 1 is a die, 2 a die retainer, 3 a die space, 4 a die holder, 5 a punch, 6 a punch holder, 7 a billet, 8 a knockout pin, 9 a blank guide. The punch 5 has a small diameter portion 51, a step portion 52 and a large diameter portion 53.

A hollow billet is inserted into the dies 1, and first, the small diameter portion of the punch is inserted into the billet by lowering the punch 5 (FIG. 1(A)). When the punch is further lowered, the step portion of punch presses down the billet, the billet is ironed by the dies to form a tube body 71 (FIG. 1(B)). The knockout pin engages the upper end surface of the tube body 71 at the lowermost position of the punch, the tube body 71 is removed from the punch and dropped upon elevation of the punch.

Figure 2:
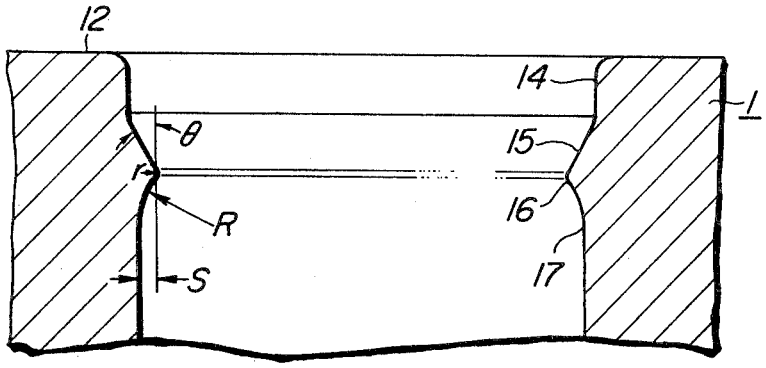
FIG. 2 is a longitudinal cross-sectional view, with essential portions enlarged, showing the dies embodying the present invention.

FIG. 2 is an enlarged view of the essential portions of the dies embodying the present invention. The dies 1 are made of tungsten carbide, and formed in the hollow portion with guide portions 14 at the side closest to the end face 12, shoulder portions 15 disposed inwardly of the guide portions, ironing portions 16 disposed further inwardly, and relief portions 17 disposed radially outwardly of the ironing portion 16.

In the die according to the present invention, the die angle $\theta$ (the angle made by the shoulder portion with the axis of die), the radius r of the ironing portion 16, the relief S (the difference in radius between the ironing portion and the relief portion) and the curvature R on the side of relief (the surface connecting the ironing portion to the relief portion) are selected within the following ranges. In addition, the center of R is disposed on the side of the hollow portion.

$\theta$ — from 10° to 20° r — from 0.7 to 2.0 mm

S — from 0.2 to 0.5 mm

R — from 10 to 15 mm (provided that the ironing rate is less then 50%)

Description will hereunder be given of the grounds of the above values.

Figure 3:
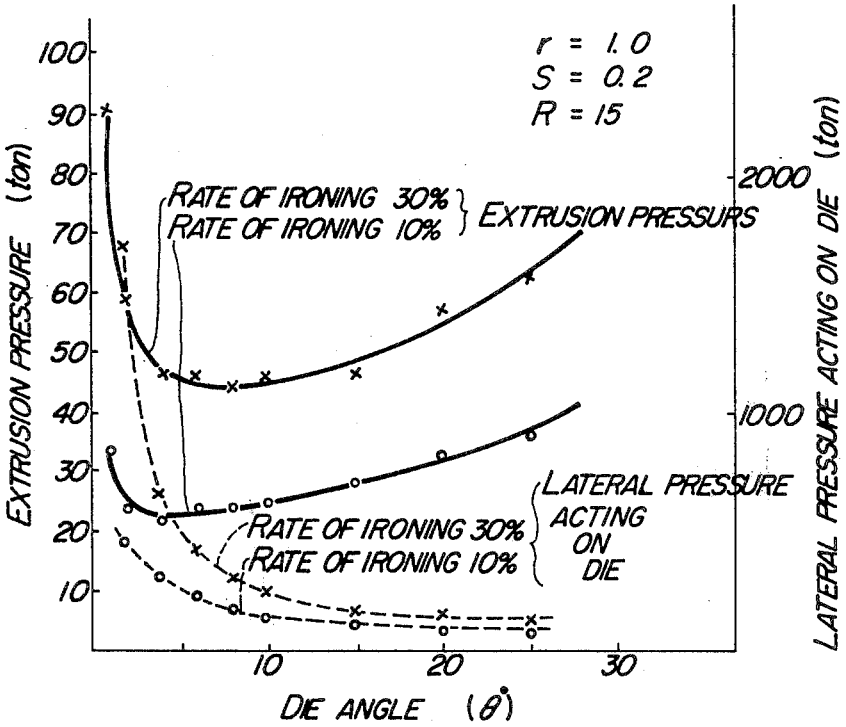
FIG. 3 is a view showing the relationship between the die angle, the extrusion pressure and the lateral pressure acting on the dies.

Firstly, the relationship between the die angle $\theta$, the extrusion pressure of the punch and the lateral pressure is as shown in FIG. 3. In addition, the ironing rate is as follows:

$$\frac{(\text{Cross-section area before ironing} - \text{cross-section after ironing})}{\text{Cross-section before ironing}} \times 100$$

The extrusion pressure indicates the minimum value in the vicinity of 2° to 15° of die angle. The extrusion pressure is sharply increased in the range of small $\theta$ because of the increase of the contact area. Also the extrusion pressure is increased in the range of large $\theta$ because of the increase of a component of force in the direction opposite to the load. For practical use, it is desirable to make the die angle $\theta$ to be less than 20°.

Additionally, the fear of fracture and wear in dies increase with the increase of the lateral pressure acting on the dies.

As apparent from the relationship shown in FIG. 3, it is desirable to make the die angle $\theta$ to be about 10° or more than that for practical use.

Figure 4:
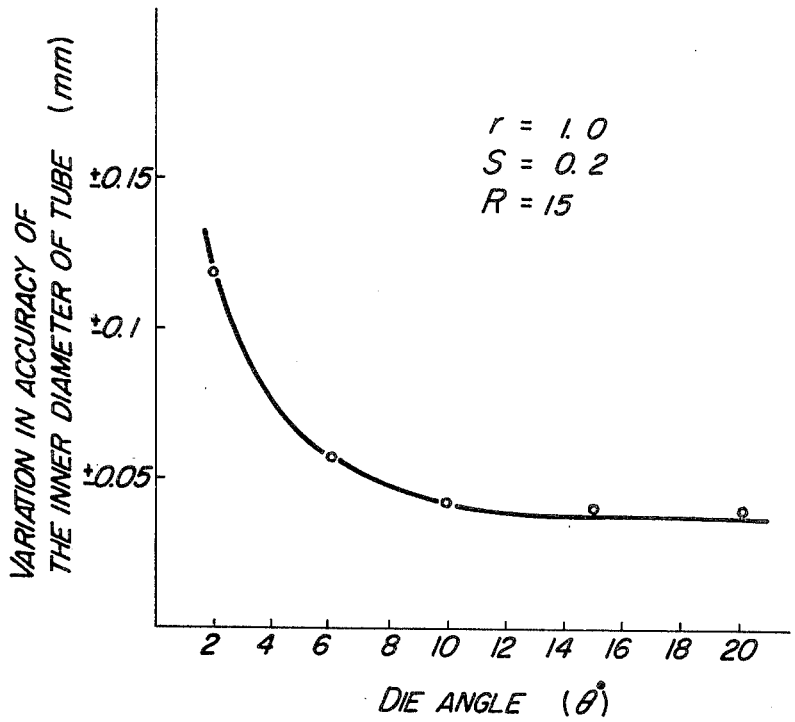
FIG. 4 is a view showing the relationship between the die angle and the variation in accuracy of the inner diameter of the tube.

Next, as the relationship between the die angle $\theta$ and the accuracy of inner diameter of the tubular products is shown in FIG. 4, the die angle $\theta$ may preferably be large. This is because the accuracy of finishing is reduced with the increase of the lateral pressure as shown in FIG. 3, and therefore, $\theta$ may preferably be about 10° or more than that.

Figure 5:
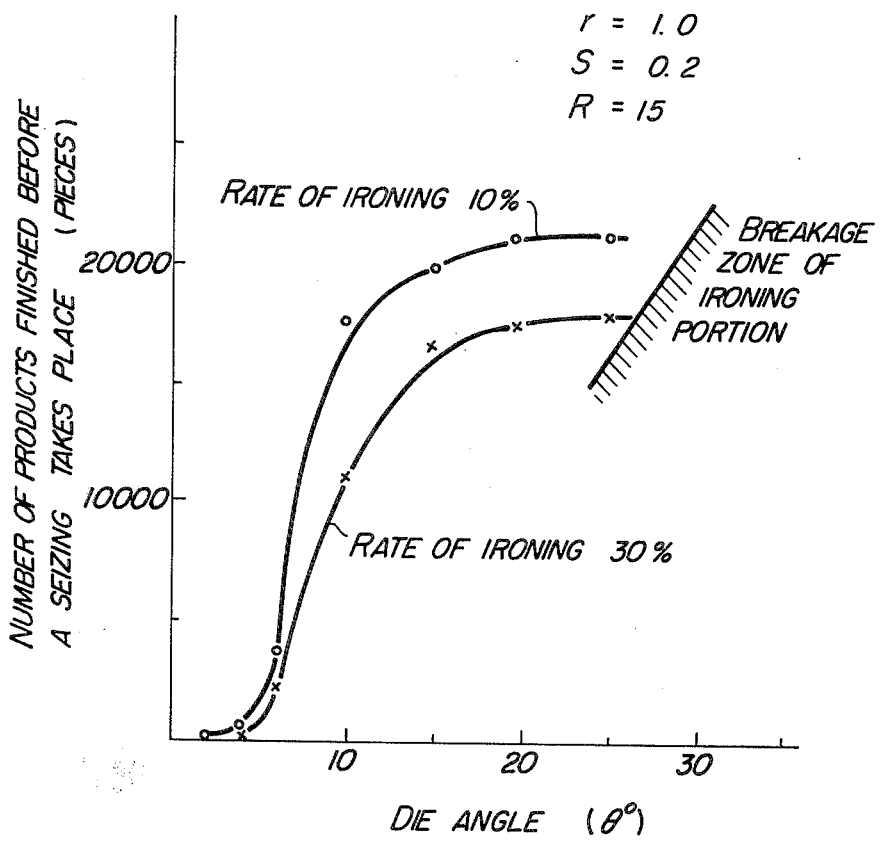
FIG. 5 is a view showing the relationship between the die angle and the number of products finished before a seizing takes place.

Additionally, as the relationship of the die angle $\theta$ with the number of products finished before a seizing takes place is shown in FIG. 5, it is desirable to make $\theta$ to be at least 10° or more than that. This is because, in the case of $\theta$ being small, the die shoulder portion and the ironing portion form a substantially straight line portion, and the contact area between the billet and said straight line portion becomes large. On the other hand, if $\theta$ is made large, the projecting extent of the vertex of ironing portion becomes large whereby the dies tend to be easily broken, thereby greatly decreasing the service life of die in the vicinity of 30°.

Figure 6:
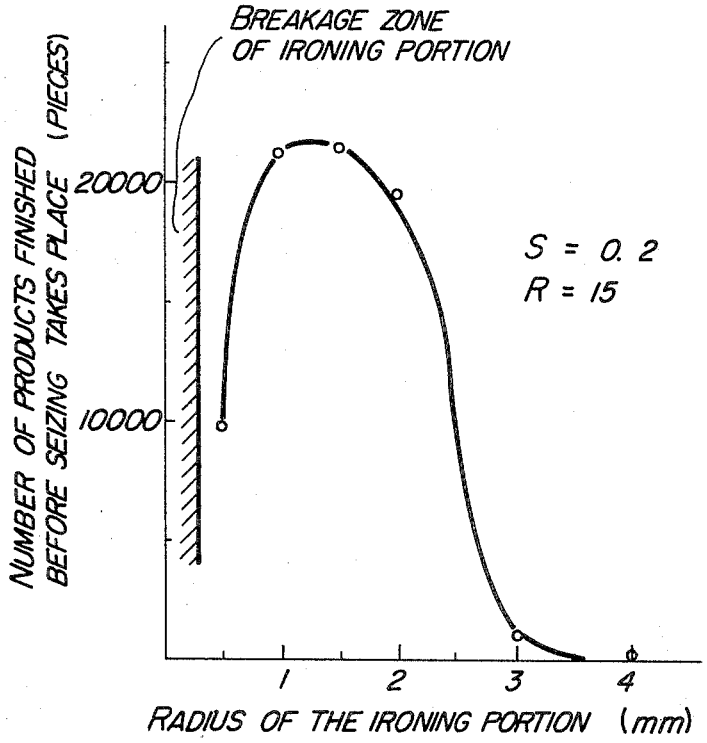
FIG. 6 is a view showing the relationship between the radius of the ironing portion and the number of products finished before a seizing takes place.

Next, the relationship between the value of the radius $r$ of the vertex of ironing portion and the number of products finished before a seizing takes place is shown in FIG. 6.

A small radius $r$ of the vertex of ironing portion results in damaging dies easily, and therefore is impracticable. In contrast with this, a large radius $r$ of the vertex leads to the increase in contact area, thereby causing a seizing easily. The value of $r$ may preferably be from 0.7 to 2.0 for practical use.

As for the relief S, if it is small, the relief will be gone in the case that the ironing portion is worn out, thus increasing the contact area easily. On the other hand, if the relief S is large, the projecting extent of the ironing portion will be large, thus unabling to withstand a large extrusion pressure. The proper value of the relief S is in the range from 0.2 to 0.5 mm for practical purposes.

Additionally, the value of the curvature R of the curved surface connecting the ironing portion and the relief surface is also one of the important factors. If R is small, the die will be easily broken due to the notch effect. If R is large, the contact area will be easily increased even if the ironing portion is worn to a small extent, thereby causing a seizing easily. The value of R may preferably be in the range of from 10 to 15 mm.

The values of $\theta$, $r$, S, and R have been described so far. However, each of these values can not be determined independently, and these values are in close relationship to one another.

In the die according to the present invention, the ironing portion has no straight line portion in parallel with the axis of die so that the contact area between the blank and the die can be maintained at the minimum. Additionally, since the ironing portion is concavely provided at the back side thereof with a curved surface, the contact area will not be increased practically even if the ironing portion is worn out. Hence, even if the die is worn out, a seizing will not take place easily. Further, the lateral pressure is kept down low by the proper selection of the die angle, and the strength of the ironing portion is maintained by the proper selection of the relief S. Particularly, the ironing of the outer diameter portion of billet is applied to press the outer diameter portion of billet on to the inner diameter of the die for improving the accuracy of finishing of the inner diameter of the billet. Thus, even if there occurs a small degree of variation in the ironing rate due to the wear of die, the acccuracy of finishing of the inner diameter of billet is not lowered.

With the dies according to the present invention, it is possible to work on a blank of high strength. For example, a blank up to about HRB 90 has been worked on so far. However, a blank up to about HRC 30 can be worked on at present. Additionally, lubricants such as Bondesite and the like which are problematical from the viewpoint of public pollution have been used in working heretofore. However, said lubricants can be replaced by the lubricating oils safer than them now.

What is claimed is:

1. A plastic working die with a hollow portion having an ironing portion thereof, said ironing portion being inwardly disposed and provided at the front thereof with a die angle portion and at the back thereof with a relief surface, and used for plastic working on cylindrical parts at an ironing rate of less than 50%, characterized in that:

the die angle portion has a die angle $\theta$ between 70° and 20°;

the ironing portion has a radius $r$ between 0.7 and 2.0 mm;

the relief surface has a relief S between 0.2 and 0.5 mm; and a curved surface connecting the ironing portion and the relief surface, the curved surface having a radius of curvature R between 10 and 15 mm with its center being on the hollow side of the die.

* * * * *